US007762701B2

(12) United States Patent
Luo et al.

(10) Patent No.: US 7,762,701 B2
(45) Date of Patent: Jul. 27, 2010

(54) REAR-LOADED LIGHT EMITTING DIODE MODULE FOR AUTOMOTIVE REAR COMBINATION LAMPS

(75) Inventors: Hong Luo, Danvers, MA (US); ZhaoHuan Liu, Mississauga (CA)

(73) Assignee: OSRAM SYLVANIA Inc., Danvers, MA (US)

( * ) Notice: Subject to any disclaimer, the term of this patent is extended or adjusted under 35 U.S.C. 154(b) by 165 days.

(21) Appl. No.: 12/259,797

(22) Filed: Oct. 28, 2008

(65) Prior Publication Data

US 2009/0296417 A1 Dec. 3, 2009

Related U.S. Application Data

(60) Provisional application No. 61/056,738, filed on May 28, 2008.

(51) Int. Cl.
*F21S 8/10* (2006.01)

(52) U.S. Cl. ..... 362/545; 362/555; 362/294

(58) Field of Classification Search ..... 362/487, 362/545, 555, 346, 348, 350, 294, 518, 517, 362/519

See application file for complete search history.

(56) References Cited

U.S. PATENT DOCUMENTS 3,700,883 A 10/1972 Donohue et al.
4,704,661 A 11/1987 Kosmatka
5,406,464 A 4/1995 Saito
5,539,629 A 7/1996 Chinniah et al.
6,474,852 B1 11/2002 Ohkohdo et al.
6,637,921 B2 10/2003 Coushaine
6,637,923 B2 10/2003 Amano
6,814,475 B2 11/2004 Amano
6,945,672 B2 9/2005 Du et al.
6,951,414 B2 10/2005 Amano
6,991,355 B1 1/2006 Coushaine et al.
7,042,165 B2 5/2006 Madhani et al.
7,075,224 B2 7/2006 Coushaine
7,110,656 B2 9/2006 Coushaine et al.

*Primary Examiner*—Gunyoung T Lee
(74) *Attorney, Agent, or Firm*—Shaun P. Montana

(57) ABSTRACT

A rear-loading LED module for a rear combination lamp is disclosed. One or more LEDs are mounted on a printed circuit board that electrically powers and mechanically holds them outside a faceted, parabolic reflector. Light emitted from the LEDs enters a light propagation region, formed between the reflective adjacent faces of two nested cylinders. The cylinders extend from the LEDs, outside the reflector, longitudinally through a hole at the vertex of the reflector, to the focus of the reflector. In some applications, the light propagation region may act as a beam homogenizer, so that light exiting the light propagation region may have roughly uniform intensity. Light from the light propagation region strikes an outwardly-flared reflector that directs it largely transversely onto the parabolic reflector. The parabolic reflector collimates the light and directs it longitudinally, through a transparent cover and out of the lamp. The parabolic reflector may have facets that angularly divert portions of the reflected light to form a desired two-dimensional angular distribution for the exiting beam.

19 Claims, 6 Drawing Sheets

REAR-LOADED LIGHT EMITTING DIODE MODULE FOR AUTOMOTIVE REAR COMBINATION LAMPS

CROSS-REFERENCE TO RELATED APPLICATIONS

The present application claims priority under 35 U.S.C §119(e) to provisional application No. 61/056,738, filed on May 28, 2008 under the title, "Side entry LED light module for automotive rear combination lamp," and incorporated by reference herein in its entirety. Full Paris Convention priority is hereby expressly reserved.

STATEMENT REGARDING FEDERALLY SPONSORED RESEARCH OR DEVELOPMENT

Not Applicable

BACKGROUND OF THE INVENTION

1. Field of the Invention

The present invention is directed to rear combination lamps for automotive lighting systems.

2. Description of the Related Art

For many years, automobiles have employed electric lighting that serves a variety of functions. For instance, lights provide forward illumination (headlamps, auxiliary lamps), conspicuity (parking lights in front, taillights in rear), signaling (turn signals, hazards, brake lights, reversing lights), and convenience (dome lights, dashboard lighting), to name only a few applications. Historically, incandescent bulbs have been used for most or all lighting in an automobile, being available in a variety of sizes, shapes, wattages, and socket packages.

In recent years, light emitting diodes (LEDs) have started to appear in some of the lighting applications for automobiles. Compared with incandescent bulbs, LEDs use less power, last longer, and have less heat output, making them well suited for automotive applications.

In the relatively short time period since LEDs have been introduced as lighting sources, automakers have adopted a cautious position. While they have been eager to adopt LEDs for all of the advantages stated above, they have been hesitant to completely abandon the familiarity of a bulb/lamp with a socket and its accompanying traditional-style optics. As a result, in recent years there have been several lighting subsystems that have the mechanical feel of the old incandescent-style bulbs and fixtures, but actually use LEDs as their light sources.

FIG. 1 shows a typical automobile 1, with typical exterior lights that front turn indicators 2, include headlamps 3, fog lamps 4, side repeaters 6, a center high mounted stop lamp 7, a license plate lamp 8, and so-called "rear combination lamps" 9 (RCLs). Any or all of these may include accessories, such as a headlamp cleaning system 5. We concentrate primarily on the rear combination lamps 9 for this application.

Note that each rear combination lamp 9 may include a tail light (also known as a marker light), a stop light (also known as a brake light), a turn signal light, and a back up light. Each light in the rear combination lamp may have its own light source, its own reflection and/or focusing and/or collimation and/or diffusing optics, its own mechanical housing, its own electrical circuitry, and so forth. In this respect, an aspect or feature of one particular light may be used for any or all of the lights in the rear combination lamp 9. Optionally, one or more functions may be shared among lights, such a circuit that controls more than one light source, or a mechanical housing that holds more than one light source, and so forth. For instance, each lighting sub-system typically has its own independent lamp, although the tail light and stop light functions may be combined in a single lamp (bulb) having a double filament.

In recent years, as LEDs have started to appear in exterior automotive lighting systems, one trend is to integrate the LEDs closely into the fixture. For instance, the center high mount stop lamps 7, or CHSMLs, are now mostly done in this fashion as it was relatively easy to adapt an LED module to the application. Because of the long life of LEDs, this may be the favored approach over time.

In other words, in the long term, the light fixtures, including the housing, the reflectors, the lens cover and any intermediate optical elements, will most likely become adapted to a configuration that is designed optimally around the LED. The electrical connections, the heat sink, the collimation and/or reflection and/or diffusing optics will most likely have designs that are primarily suited to LEDs, rather than primarily to conventional incandescent bulbs or lamps and then modified to include LED light sources.

However, in the short term, many automakers prefer familiar and known technology, including known reflector and bulb geometries that were developed for incandescent lamps and have been used for many years. As a result, several lighting manufacturers have developed rear combination lamp systems that use LEDs as their light sources, but use conventional light set socket openings and traditional style optics. The lamp is accessible from the back, i.e., from the side opposite the viewer, as is conventional with older incandescent systems. These lamp systems are appealing to automakers in the short term because the mechanical aspects of the lamp systems are consistent with the older, established systems that use incandescent bulbs. An example of such a lamp system is the JOULE product, which is commercially available from Osram Sylvania, based in Danvers, Mass.

There have been various designs for these lamp systems that use LED sources but have the mechanical feel of the older incandescent systems. Each of these designs had some drawbacks, such as difficulty during assembly, or a low optical efficiency, caused by losses.

An example of one of these known designs is disclosed in U.S. Pat. No. 6,991,355, issued on Jan. 31, 2006 to Coushaine et al., and assigned to OSRAM Sylvania Inc., based in Danvers, Mass. In this design, various LEDs 22 are attached to one side of a printed circuit board 20, and a heat sink 25 is attached to the other side of the printed circuit board 20. The LEDs 22, circuit board 20 and heat sink 25 are all located outside a concave reflector 50, adjacent to the base (vertex) of the reflector. Light from each LED 22 is directed into the interior of the reflector 50 via a respective light guide 30 that extends from the LED 22 through a hole at the vertex of the reflector 50. The exiting face of each light guide 30 is located at the focus of the reflector 50, so that light emitted from an LED 22 enters the light guide 30, exits the light guide 30 at the focus of the reflector 50, reflects off the reflector 50 and emerges from the lamp as a collimated beam. One of the designs uses a curved light guide 30*a*, so that the exiting face of the light guide is oriented appropriately, and the light exiting from the light guide travels in a suitable direction and strikes the reflector 50 in a suitable location. Another of the designs uses a straight light guide 30 with an intermediate reflector 26 to direct the light guide output appropriately onto the reflector 50.

In the design of '355, the light guide 30 may be the source of loss. Typical light guides are largely cylindrical rods of plastic or glass, with all surfaces being smooth, or as smooth as possible for a molded component. There may be additional polishing steps performed on the part, but such polishing steps add undesirable expense to the light guide, and therefore, to the whole lamp unit.

The longitudinal faces of the light guide are the entrance and exiting faces, and both may introduce loss. For instance, if the faces are uncoated, there may be a reflection loss of about 4% per surface, due to the difference in refractive index between the rod and air. Such reflection loss may be reduced by applying anti-reflection coatings to the longitudinal faces, but this may add undesirable expense to the light guide, and, therefore, to the whole lamp unit. In addition, there may be additional losses at the longitudinal faces caused by scattering. Such scattering losses may be reduced somewhat by ensuring that the longitudinal faces are relatively smooth, but in practice, these scattering losses are difficult to eliminate.

The transverse face of the light guide is typically left uncoated, so that light propagating along the interior of the light guide experiences total internal reflection at each bounce off the exterior face. There may be scattering losses caused by surface roughness, contaminants, or other imperfections along the transverse face. As with the scattering losses from the longitudinal faces, the scattering losses from the transverse face may be difficult to eliminate.

Accordingly, it would be beneficial to provide a rear combination lamp that uses LEDs as its light source, inserts from the back of the lamp, and eliminates the optical losses and expense of a light guide.

Because the present application is directed to automotive lighting systems, it is beneficial to first review some terminology.

The parts that make up the lighting systems at the corners of vehicles are known as "light sets". In buildings, the equivalent of "light sets" would be fixtures. A light set typically includes a plastic structure or housing, one or more reflectors, lens optical systems in some cases, and a lens cover usually fitting the exterior styling of the vehicle and often having colored sections, such as amber and red. The housing of the light set includes socket openings, usually in the rear, to receive and retain a socket with a lamp (commonly referred to in the U.S. as a "bulb"), venting means, and in some cases for forward lighting, adjuster means.

In general, there are four key elements for an LED-based lighting module: (1) the actual LED chip or die, (2) the heat sink or thermal management, which dissipates the heat generated by the LED chip, (3) the driver circuitry that powers the LED chip, and (4) the optics that receives the light emitted by the LED chip and directs it toward a viewer. These four elements need not be redesigned from scratch for each particular module; instead, a particular lighting module may use one or more elements that are already known. The following paragraphs describe several of these known elements, which may be used with the LED-based lighting module disclosed herein.

U.S. Pat. No. 7,042,165, titled "Driver circuit for LED vehicle lamp", issued to Madhani et al., and assigned to Osram Sylvania Inc. of Danvers, Mass., discloses a known driver circuit for LED-based lighting modules, and is incorporated by reference herein in its entirety. In '165, a first vehicle lamp driver circuit for a light emitting diode (LED) array is disclosed, the LED array having a first string of four LEDs in series and a second string of four LEDs in series. A first LED driver drives the first LED string and a second LED driver drives the second LED string. In a STOP mode of operation, the current to both LED strings is controlled by the LED driver in series with the LED string. In a TAIL mode of operation, the current is provided to only one LED string via a series connected diode and resistor. When there is reduced input voltage, operation of the LED strings is provided by switching circuits that short-out one LED in each LED string. A second vehicle lamp driver circuit comprises a first LED string and a second LED string in series with a control switch having a feedback circuit for maintaining constant current regulation to control the sum of the current in each LED string and reduce switching noise. The driver circuit disclosed by '165 may be used directly or may be easily modified to drive the LED chip for the lighting module disclosed herein.

U.S. Pat. No. 7,110,656, titled "LED bulb", issued to Coushaine et al., and assigned to Osram Sylvania Inc. of Danvers, Mass., discloses a complementary socket and electrical connector mechanical structure for LED-based lighting modules, and is incorporated by reference herein in its entirety. In '656, an LED light source has a housing having a base. A hollow core projects from the base and is arrayed about a longitudinal axis. A printed circuit board is positioned in the base at one end of the hollow core and has a plurality of LEDs operatively fixed thereto about the center thereof. In a preferred embodiment of the invention the hollow core is tubular and the printed circuit board is circular. A light guide with a body that, in a preferred embodiment, is cup-shaped as shown in FIGS. 2 and 4*a*, has a given wall thickness "T". The light guide is positioned in the hollow core and has a first end in operative relation with the plurality of LEDs and a second end projecting beyond the hollow core. The thickness "T" is at least large enough to encompass the emitting area of the LEDs that are employed with it. The complementary socket and electrical connector mechanical structure disclosed by '656 may be used directly or may be easily modified for the lighting module disclosed herein.

U.S. Pat. No. 7,075,224, titled "Light emitting diode bulb connector including tension receiver", issued to Coushaine et al., and assigned to Osram Sylvania Inc. of Danvers, Mass., discloses another complementary socket and electrical connector mechanical structure for LED-based lighting modules, and is incorporated by reference herein in its entirety. In '224, an LED light source (10) comprises a housing (12) having a base (14) with a hollow core (16) projecting therefrom. The core (16) is substantially conical. A central heat conductor (17) is centrally located within the hollow core (16) and is formed from solid copper. A first printed circuit board (18) is connected to one end of the central heat conductor and a second printed circuit board (20) is fitted to a second, opposite end of the central heat conductor (17). The second printed circuit board (20) has at least one LED (24) operatively fixed thereto. A plurality of electrical conductors (26) has proximal ends (28) contacting electrical traces formed on the second printed circuit board (20) and distal ends (30) contacting electrical traces on the first printed circuit board (18). Each of the electrical conductors (26) has a tension reliever (27) formed therein which axially compresses during assembly. A cap (32) is fitted over the second printed circuit board (20); and a heat sink (34) is attached to the base and in thermal contact with the first printed circuit board. As with '656, the complementary socket and electrical connector mechanical structure disclosed by '224 may be used directly or may be easily modified for the lighting module disclosed herein.

U.S. Pat. No. 6,637,921, titled "Replaceable LED bulb with interchangeable lens optic", issued to Coushaine, and assigned to Osram Sylvania Inc. of Danvers, Mass., discloses a reflective optic that can receive light from an LED, emitted perpendicular to a circuit board, and reflect it in a number of directions, all roughly parallel to the circuit board. The optic disclosed by '921 may have the shape of an inverted cone, with the point of the cone facing the LED chip. The cone may be continuous, or may alternatively have discrete facets that approximate the shape of a cone. The reflective optic may be used with a single LED chip, or multiple LED chips arranged around the point of the cone. The reflective optic disclosed by '921 may be used with the LED-based lighting module disclosed herein, and may be disposed in the optical path between the LED chip and the reflector that directs the LED light towards a viewer.

BRIEF SUMMARY OF THE INVENTION

An embodiment is an automotive rear combination lamp (10), comprising: a concave reflector (85, 13) having a focus and having an aperture at its vertex, for receiving transversely propagating diverging light and reflecting longitudinally propagating collimated light; an outwardly-flared reflector (75) disposed at the focus of the concave reflector (85), for receiving longitudinally propagating guided light and reflecting transversely propagating diverging light to the concave reflector (85); and a light guiding region for receiving longitudinally propagating diverging light from at least one light emitting diode (35) and producing longitudinally propagating guided light. The light guiding region is formed between a convex reflecting surface (65) and a concave reflecting surface (45), the convex and concave reflecting surfaces (65, 45) having cross-sections that are nested, continuous and concentric. The light guiding region extends through the aperture at the vertex of the concave reflector (85). The at least one light emitting diode (35) is disposed outside the concave reflector (85).

Another embodiment is an automotive rear combination lamp (10), comprising: an inner cylinder (61) having a proximal end and a distal end opposite the proximal end, the inner cylinder (61) comprising a convex cylindrical reflective surface (65); an outer cylinder (43) surrounding the inner cylinder (61), the outer cylinder (43) comprising a concave cylindrical reflective surface (45) coaxial with and facing the convex cylindrical reflective surface (65), the convex and concave cylindrical reflective surfaces (65, 45) transversely defining a light propagation region; a printed circuit board (31) disposed at the proximal end of the inner cylinder (61); a plurality of light emitting diodes (35) disposed on the printed circuit board (31), the diodes (35) being capable of being electrically powered by the printed circuit board (31), the diodes (35) being capable of generating light that propagates longitudinally away from the printed circuit board (31) in the light propagation region; and an outwardly-flared reflector (75) disposed at the distal end of the inner cylinder (61) and adjacent to the light propagation region, for transversely reflecting light that propagates longitudinally in the light propagation region, the flared reflector having an increasing cross-sectional diameter from proximal to distal ends.

A further embodiment is an automotive rear combination lamp (10), comprising: a printed circuit board (31); an inner cylinder (61) extending away from the printed circuit board (31) and comprising a convex cylindrical reflective surface (65); an outer cylinder (43) surrounding the inner cylinder (61), the outer cylinder (43) comprising a concave cylindrical reflective surface (45) coaxial with and facing the convex cylindrical reflective surface (65), the convex and concave cylindrical reflective surfaces (65, 45) transversely defining a light propagation region; a plurality of light emitting diodes (35) disposed on the printed circuit board (31), the diodes (35) being capable of being electrically powered by the printed circuit board (31), the diodes (35) being capable of generating light that propagates longitudinally away from the printed circuit board (31) in the light propagation region; and a trumpet-shaped reflector (75) disposed at a longitudinal end of the inner cylinder (61), opposite the printed circuit board (31) and adjacent to the light propagation region, for transversely reflecting light that propagates longitudinally in the light propagation region; a concave reflector (85) for collimating and longitudinally reflecting light that is transversely reflected by the trumpet-shaped reflector (75), the concave reflector (85) having a focus and having an aperture at its vertex; and a transparent cover (15) for transmitting collimated light from the concave reflector (85). The inner and outer cylinders (61, 43) extend through the aperture at the vertex of the concave reflector (85). The trumpet-shaped reflector (75) is disposed at the focus of the concave reflector (85). The printed circuit board (31) is disposed outside the concave reflector (85).

DETAILED DESCRIPTION OF THE INVENTION

Figure 1:
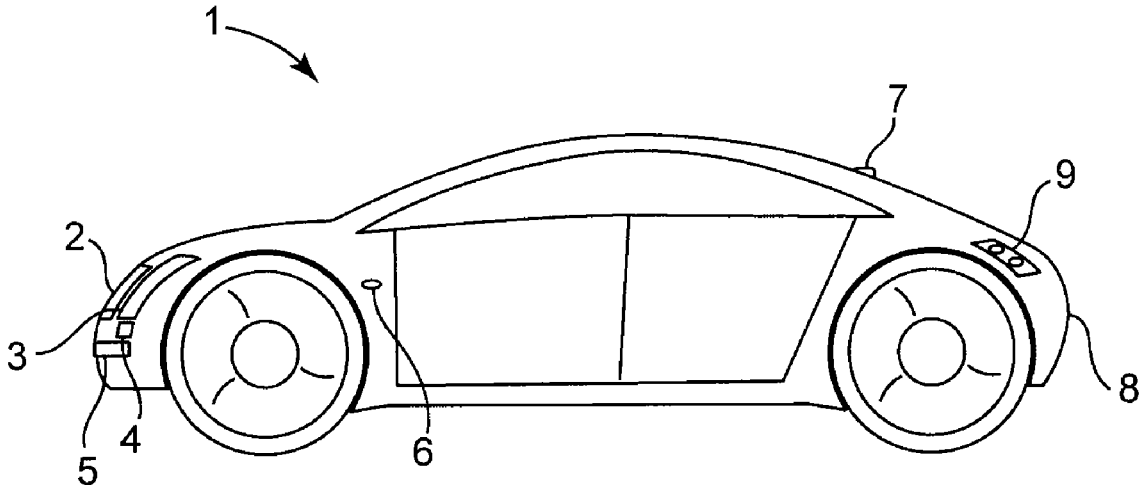
Fig. 1 PRIOR ART
FIG. 1 is a schematic drawing of the exemplary external lighting of an automobile.

The light emitting diode (LED) module disclosed herein may be used for exterior vehicle lighting. The LED module may be installed in a light set socket from the back, in a manner similar to that used with conventional incandescent bulbs. The LED module may include optical elements suitable to distribute the light to a reflector that receives light from the LED chip(s) and directs the reflected light toward a viewer. This is disclosed more fully in the detailed description below.

For typical, known rear combination lamps that use light emitting diodes as their light sources, there have been numerous ways of ensuring that the output light exits the device with the proper orientation. For instance, the first generation system commercially available with the name JOULE used light emitting diodes mounted at a particular angle. The assembly process for this first generation system was undesirably complicated, and included a difficult connection between the LEDs and control circuit boards. For the second generation JOULE system, this mounting scheme for the light emitting diodes was replaced with a light guide and a small reflector that image the emission point of the LED onto the focal point of the rear combination lamp reflector. The light guide is typically a transparent tube of glass or plastic, with smooth sides that ensure that a beam transmitted along the light guide experiences total internal reflection at each reflection off the sides. The light guide, while an improvement over the first generation product, is still an extra component in the system, thereby increasing the cost of the system, and is still lossy, losing a fraction of light at the entering and exiting interfaces of the light guide. Additional LEDs were required to overcome the losses introduced by the light pipe and associated optics. A system using side-emitting light emitting diodes has also been tried, but also had either assembly difficulties or a low optical efficiency.

In general, all of the previous rear combination lamps exhibit some sort of deficiency, whether it is a difficulty in assembly, a low optical efficiency, or an incompatibility with current housings for rear combination lamps.

The present invention overcomes these deficiencies and may provide one or more of the following advantages:

First, the light emitting diode module is fully integrated, thereby reducing the number of components and simplifying the assembly of the module. Furthermore, because the light emitting diodes and electronics are on the same board, there is no need for an additional interconnection between them.

Second, the light emitting diode module is backwards-compatible, and has optical and mechanical characteristics that match, or are readily adaptable to, those of current rear combination lamp housings.

Third, the loss of the LED module is reduced, thereby increasing the brightness of the module and/or reducing the amount of electrical power required to operate the module. A light pipe or any additional optics is not needed.

We provide a brief summary of the disclosure in the following paragraph, followed by a detailed description of the optical path in the rear combination lamp, followed by a detailed description of the mechanical aspects of the rear combination lamp.

A rear-loading LED module for a rear combination lamp is disclosed. One or more LEDs are mounted on a printed circuit board that electrically powers and mechanically holds them outside a faceted, parabolic reflector. Light emitted from the LEDs enters a light propagation region, formed between the reflective adjacent faces of two nested cylinders. The cylinders extend from the LEDs, outside the reflector, longitudinally through a hole at the vertex of the reflector, to the focus of the reflector. In some applications, the light propagation region may act as a beam homogenizer, so that light exiting the light propagation region may have roughly uniform intensity. Light from the light propagation region strikes an outwardly-flared reflector that directs it largely transversely onto the parabolic reflector. The parabolic reflector collimates the light and directs it longitudinally, through a transparent cover and out of the lamp. The parabolic reflector may have facets that angularly divert portions of the reflected light to form a desired two-dimensional angular distribution for the exiting beam.

Having provided a brief summary of the disclosure, we next provide a discussion of the optical path in the rear combination lamp, followed by a more detailed discussion of the mechanical implementation of the optical components.

Figure 2:
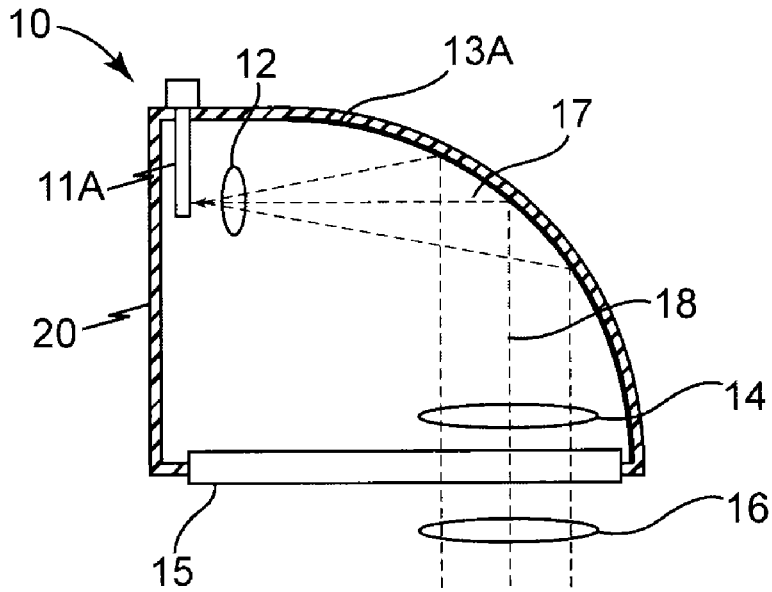
FIG. 2 is a cross-sectional schematic drawing of a simplified optical path in a rear combination lamp, having a single LED and an un-faceted reflector.
Figure 7:
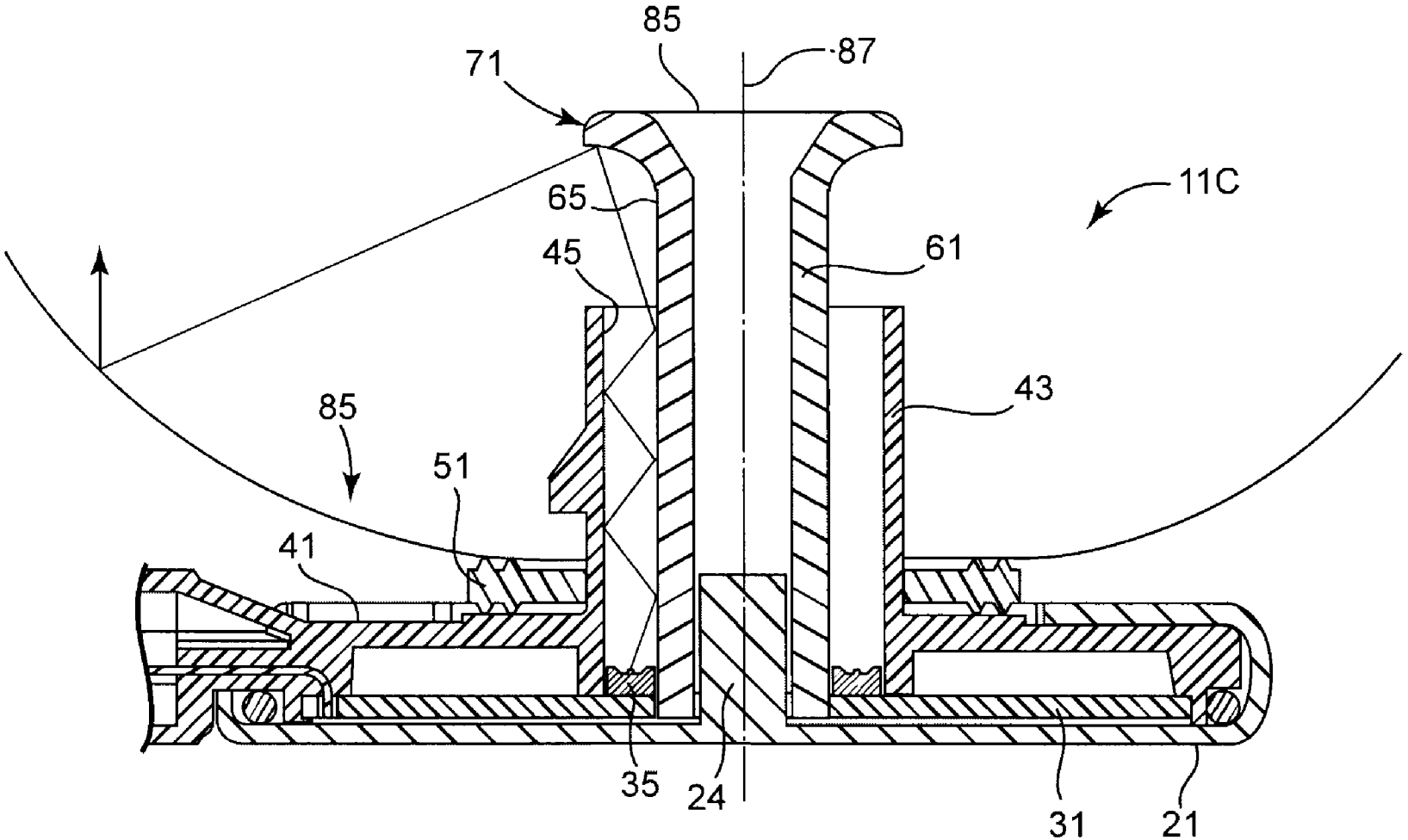
FIG. 7 is a cross-sectional schematic drawing of the LED module of FIGS. 5 and 6.

FIG. 2 is a cross-sectional schematic drawing of a simplified optical path in a rear combination lamp 10. Note that this optical path may be considered a "half paraboloid". In some cases, more than a half-paraboloid may be needed to collect and reflect all the light from the LEDs. In those cases, a full paraboloid may be used, which subtends a full 360 degrees. An example of such a full paraboloid is shown in FIG. 7 and is discussed below. For the schematic discussion here, it is sufficient to describe the operation of this half paraboloid, with the expectation that rays reflecting from the full paraboloid behave in the same manner.

An LED module 11A emits a diverging beam 12 laterally, toward the side of the rear combination lamp 10. The diverging beam has a peak brightness along a particular direction, denoted here as an optical axis 17. The diverging beam 12 may be characterized by a particular angular distribution or an angular width, which describes how quickly the beam's brightness decreases, as a function of angle. For instance, the diverging beam may have a characteristic full-width-at-half-maximum (FWHM) for its intensity or brightness, or a half-width-at-1/e^2-in-intensity, or any other suitable angular width. The characteristic angular widths of the diverging beam may be the same or may be different along the x- and y-directions, where the optical axis may be considered to be the z-direction. The size of the diverging beam grows as it propagates along the optical axis 17, roughly in proportion to the distance from the LED module 11A.

In this simplified optical path of FIG. 2, there is only a single LED in the LED module 11A. In practice, there may be more than one LED in the module; this case is treated explicitly following the discussion of the simplified system in FIG. 2.

The diverging beam 12 strikes a concave reflector 13A, which collimates the beam and reflects a collimated beam 14 longitudinally, toward the front of the rear combination lamp 10.

The reflector 13A may have the shape of a paraboloid, which is parabolic in a cross-section that includes its vertex. It is known that parabolic reflectors form a virtually aberration-free collimated beam from a light source placed at the focus of the paraboloid. Longitudinal shifting of the source away from the focus may produce defocus, or deviation away from collimation, or, equivalently, deviation of the light flux away from parallelism. Lateral shifting of the source away from the focus may produce a pointing error of the reflected collimated beam. In other words, for a laterally shifted source, the reflected beam is still collimated, but the reflected beam may angularly deviate from the un-shifted case. In general, the value of such an angular shift, in radians, equals the lateral shift of the source, divided by the focal length of the parabolic reflector. For large enough lateral shifts away from the focus, the reflected beam may also exhibit monochromatic wavefront aberrations, such as coma.

In FIG. 2, one may consider the optical axis to bend at the reflector, so that for the collimated beam, the optical axis 18 may be oriented largely longitudinally, toward the front of the rear combination lamp 10. In some applications, the optical axis 17, 18 may bend by 90 degrees at the reflector. In other applications, it may bend by slightly more than 90 degrees or slightly less than 90 degrees. For all of these cases, we may refer to the diverging beam 12 as having a "largely" lateral orientation, and collimated beam 14 as having a "largely" longitudinal orientation.

The collimated beam 14 may be commonly referred to in the literature as "parallel light flux". These terms are interchangeable, and may be considered equivalent as used in this application.

After passing through a transparent "clear cover" or "lens cover" 15, the collimated beam 14 remains collimated 16, and exits the rear combination lamp 10 at the rear of the automobile, toward the viewer. The clear cover 15 may have an optional spectral effect, such as filtering one or more wavelengths or wavelength bands from the transmitted light, but typically does not scatter the beam, as a diffuser would.

The LED module 11A, the reflector 13A, and the clear cover 15 may all be held mechanically by a housing 20. Such a housing 20 may be desirable in that it can be manufactured inexpensively, and may be molded or stamped to include the surface profile of the reflector 13.

The mechanical aspects of the rear combination lamp 10 are discussed in much greater detail below, following the current description of the optical path.

The simplified rear combination lamp 10 of FIG. 2 may require some modifications before it can meet the legal requirements for a rear combination lamp; recall that those requirements were defined for incandescent lamps, and that new LED-based lamps may be designed to have their outputs "look like" those from incandescent-style fixtures, in order to meet the old requirements.

For instance, the rear combination lamp may require more light output power than is possible or convenient from a single LED. Such a multi-LED is shown schematically, in simplified form, in FIG. 3.

Compared with the rear combination lamp 10 of FIG. 2, the only different component is a multi-LED module 11B, which includes three LEDs. In this simplified schematic, the LEDs all emit light in roughly the same direction, to within typical manufacturing, assembly and/or alignment tolerances. In other applications, one or more LEDs may point in different directions.

The light from each of the three LED sources on the multi-LED module 11B is traced throughout the rear combination lamp 10, so there are three sets of dashed lines to represent the beam. The effect of having multiple, spatially separated sources, in such a system is that there may be some small angular deviation of some rays in beam 16 away from the optical axis 18. Such angular deviation is typically small, such as on the order of only a few degrees, and the output beam 16 is still considered to be collimated.

From an optics perspective, it is desirable to have the LEDs as close together as possible. However, from a thermal perspective, it is desirable to have the LEDs as far apart as possible, so that the heat generated by each LED may be dissipated efficiently. In practice, the LEDs may be spaced apart on a printed circuit board by up to a few mm or more. The thermal aspects of the rear combination lamp 10 are discussed more fully below, following the current description of the optical path.

Figure 3:
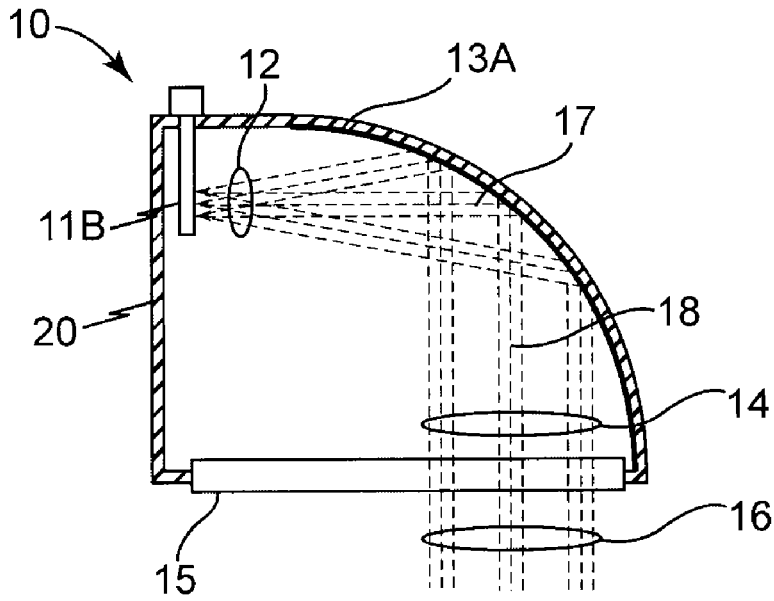
FIG. 3 is a cross-sectional schematic drawing of a simplified optical path in a rear combination lamp, having multiple LEDs and an un-faceted reflector.

The simplified rear combination lamp 10 of FIG. 3 may have sufficient output optical power, but it may not have a suitable angular distribution of light in the output beam 16. In other words, the output beam 16 may be too strongly directional, so that if a viewer's line of sight is outside the relatively narrow output beam 16, the lamp may not appear bright enough.

This may be understood more clearly by examining the lamp output angular requirements and their evolution from the output of incandescent bulbs. Light emerging from an old-style reflector fixture includes two portions that are superimposed: (1) Light that travels from the bulb directly out the clear cover, and (2) Light from the bulb that reflects off the parabolic reflector. Portion (1) is diverging, while portion (2) is generally collimated. The combination of these two portions, in the space away from the automobile, has an angular dependence, with the intensity being greater when the viewer's line of sight is within the collimated beam from portion (2). However, the angular dependence is dampened by the relative weak angular dependence of portion (1). According to legal regulations, typical cutoff values for angular output evolved to be about +/−10 degrees in the vertical direction and about +/−20 degrees laterally, so that the light from the lamp could be adequately seen if a viewer's line of sight is "within" the angular cutoff, but not necessarily need to be seen if the viewer's line of sight is outside the angular cutoff.

As a result, the output beam 16 from the simplified rear combination lamp 10 of FIG. 3 may be too narrow to meet the angular requirements of about +/−10 degrees vertically and about +/−20 degrees laterally, since its angular extent may be only +/− a few degrees at most. A known element that was developed for angularly broadening a beam without significantly altering its collimation is shown in FIG. 4, and may be referred to as a "faceted" reflector.

Figure 4:
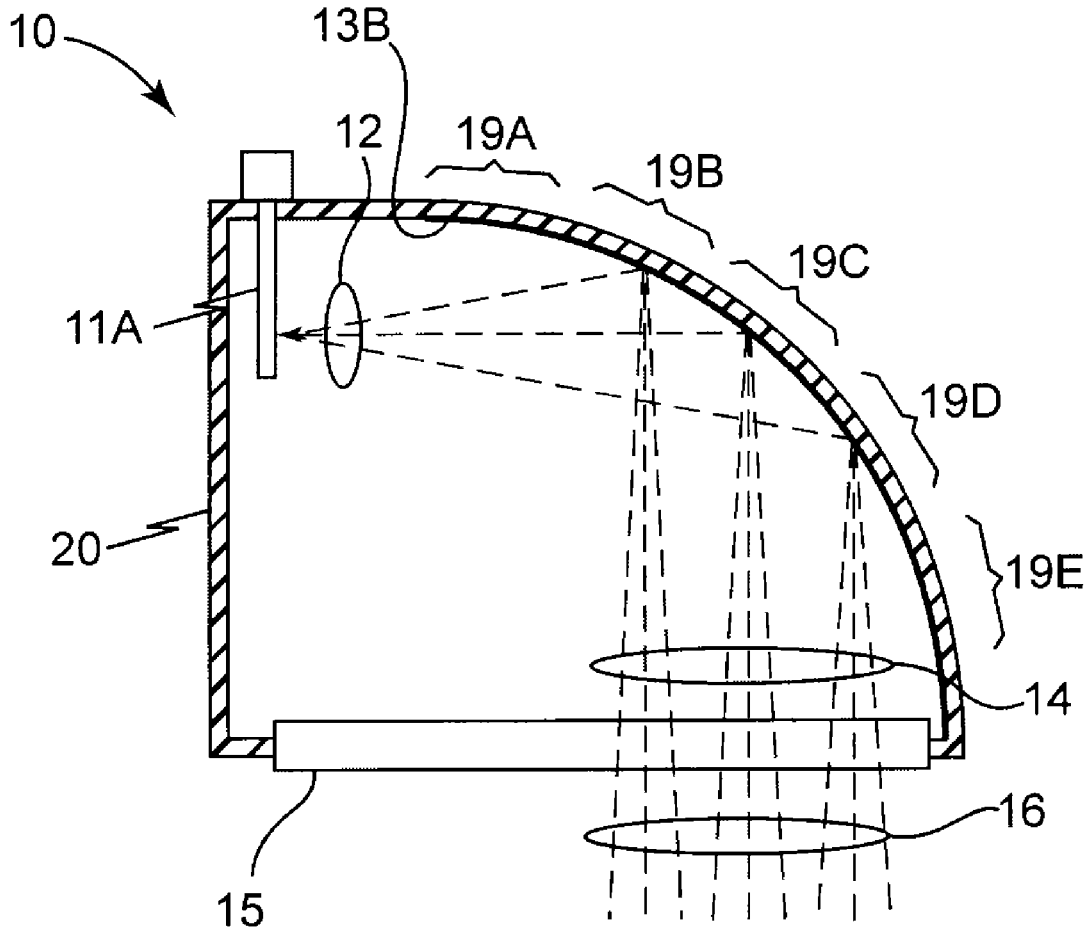
FIG. 4 is a cross-sectional schematic drawing of a simplified optical path in a rear combination lamp, having a single LED and a faceted reflector.

Compared with the schematic drawing of FIG. 2 of the simplified rear combination lamp 10, the only difference in FIG. 4 is the replacement of the simple parabolic reflector 13A with faceted parabolic reflector 13B. In general, faceted reflectors are known in the industry, and have been disclosed in the patent literature as far back as 1972 or earlier. Three such known faceted reflectors are summarized below. It will be appreciated that in addition to the three examples summarized below, any suitable faceted reflector design may be used. For the exemplary drawing in FIG. 4, each facet 19A, 19B, 19C, 19D and 19E directs light into generally the same predetermined angular range, with the full lamp output having generally the same angular range as each of the facets. In alternate embodiments, each facet may direct light into its own individual predetermined angular range, with the full lamp output including the angular contributions from all the facets.

One of the relatively early faceted reflector designs is disclosed in U.S. Pat. No. 3,700,883, titled "Faceted reflector for lighting unit", issued on Oct. 24, 1972 to Donohue et al., and incorporated by reference in its entirety herein. Donohue discloses a prescription for making the reflector, including setting the number, size, curvature and location of each facet to produce undistorted reflected images of the light source, the cumulative effective of which produces the desired illumination distribution within prescribed limits. Because true parabolic cylindrical surfaces were difficult to manufacture in 1972, Donohue includes mathematical approximations to allow for the use of circular cylindrical surfaces instead.

Another faceted reflector design is disclosed in U.S. Pat. No. 4,704,661, titled "Faceted reflector for headlamps", issued on Nov. 3, 1987 to Kosmatka, and incorporated by reference in its entirety herein. In contrast with the earlier Donohue patent that used right cylindrical surfaces, the Kosmatka patent uses right parabolic cylindrical surfaces and simple rotated parabolic surfaces.

A third known faceted reflector design is disclosed in U.S. Pat. No. 5,406,464, titled "Reflector for vehicular headlamp", issued to Saito on Apr. 11, 1995, and incorporated by reference in its entirety herein. Saito discloses a reflector that has several reflecting areas, with each reflecting area including several segments. Each segment has a basic curved surface (hyperbolic paraboloid, elliptic paraboloid, or paraboloid-of-revolution), and is laid out on a paraboloid-of-revolution reference surface having locally different focal distances.

As used in the rear combination lamp 10 of FIG. 4, the faceted reflector 13B receives the diverging beam 12 from the LED module 11A, collimates the beam and angularly diverts portions of the beam, and directs the collimated and angularly diverted beam 14 to the clear cover 15, through which light exits the lamp 10.

The optical schematic drawings of FIGS. 2-4 show LED modules 11A and 11B that mechanically hold one or more LEDs at the focus of the faceted reflector 13B. For a variety of reasons, it may be desirable to locate the LEDs outside the reflector and port the light from the LEDs through a hole in the reflector, to the focus of the reflector. In some known designs, this porting was performed by a light guide.

As stated above in the discussion of U.S. Pat. No. 6,991,355, the light guide may be a source of loss. For instance, typical LEDs have "Lambertian" type emission pattern with a beam angle around 120 degrees. However, typical acceptance angle of plastic or glass type light guide is much smaller than 120 degrees. Light emitted at angle larger than the acceptance angle of the light pipe is wasted. In addition, there may be additional losses at the longitudinal and transverse faces caused by scattering. In many cases, it would be desirable to eliminate the light guide itself while retaining the functionality of porting light from the LEDs, through the wall of the parabolic reflector, to the focus of the parabolic reflector.

In this application, the light from the LEDs is ported to the focus of the reflector by free-space propagation in a so-called "light guiding region" or "light propagation region", which is formed as the volume between two nested cylinders or other suitable shapes. The convex and concave sides of the cylinders that face each other are coated to be highly reflective. Light that enters one longitudinal end of the light guiding region at one end undergoes multiple reflections between the convex and concave reflective surfaces, and emerges from the other longitudinal end of the light guiding region.

The optical path inside the light guiding region has a relatively high sensitivity to the initial position and angle of a particular light ray. In other words, a small change of an incident particular ray can produce a large change in the position and angle of the corresponding exiting ray. For instance, the number of reflections inside the light guiding region may be more for ray that has a large transverse component, compared to a largely longitudinally propagating ray.

Because of these effects, the light guiding region is said to have a homogenizing effect, making its output appear with a nearly uniform intensity. In some applications, this may be referred to as a beam homogenizer. The exiting face of the light guiding region, which is a ring at the far longitudinal end of the light guiding region, may have a nearly uniform intensity, meaning that the intensity may be roughly the same, regardless of where on this exiting face the intensity is measured. The light emerging from this exiting face diverges from the exiting face itself, so that in many applications it is desirable to locate the exiting face of such a beam homogenizer at the focus of the concave reflector.

In this application, the exiting face of the light guiding region is roughly coincident with the outwardly-flared reflector, so that both may be considered to be at the focus of the concave reflector.

We summarize the optical path in the lamp 10 of FIG. 4 before discussing the mechanical package for the lamp. An LED module is inserted in through the back of a faceted parabolic reflector 13B. The LED module has one or more LED sources emitting into a light guiding region, which is formed as the volume between two nested cylinders or other suitable shapes. As light propagates longitudinally along the cylinders, the beam becomes homogenized. The output from the distal end of the light guiding region has a roughly uniform intensity and reflected by an outwardly-flared reflector to propagate away from the LED module towards the parabolic reflector. The diverging beam 12 from the LED module 11B strikes the faceted parabolic reflector, 13B so that the optical axis 17 has about a 45 degree angle of incidence, and the reflected optical axis 18 leaves the reflector at about a 45 degree angle of exitance. The incident optical axis 17 is largely horizontal and lateral, and the reflected optical axis 18 is largely longitudinal. The parabolic reflector 13B collimates the beam and reflects a collimated beam, and the facets produce a particular angular distribution to the reflected collimated beam 14. The reflected collimated beam 14 passes through the clear cover 15 and becomes the exiting beam 16 that propagates toward a viewer.

Having summarized the optical path, we now discuss the mechanical package of the rear combination lamp 10, which holds the optical components in place, delivers electrical power to the LEDs, and dissipates heat produced by the LEDs.

Figure 5:
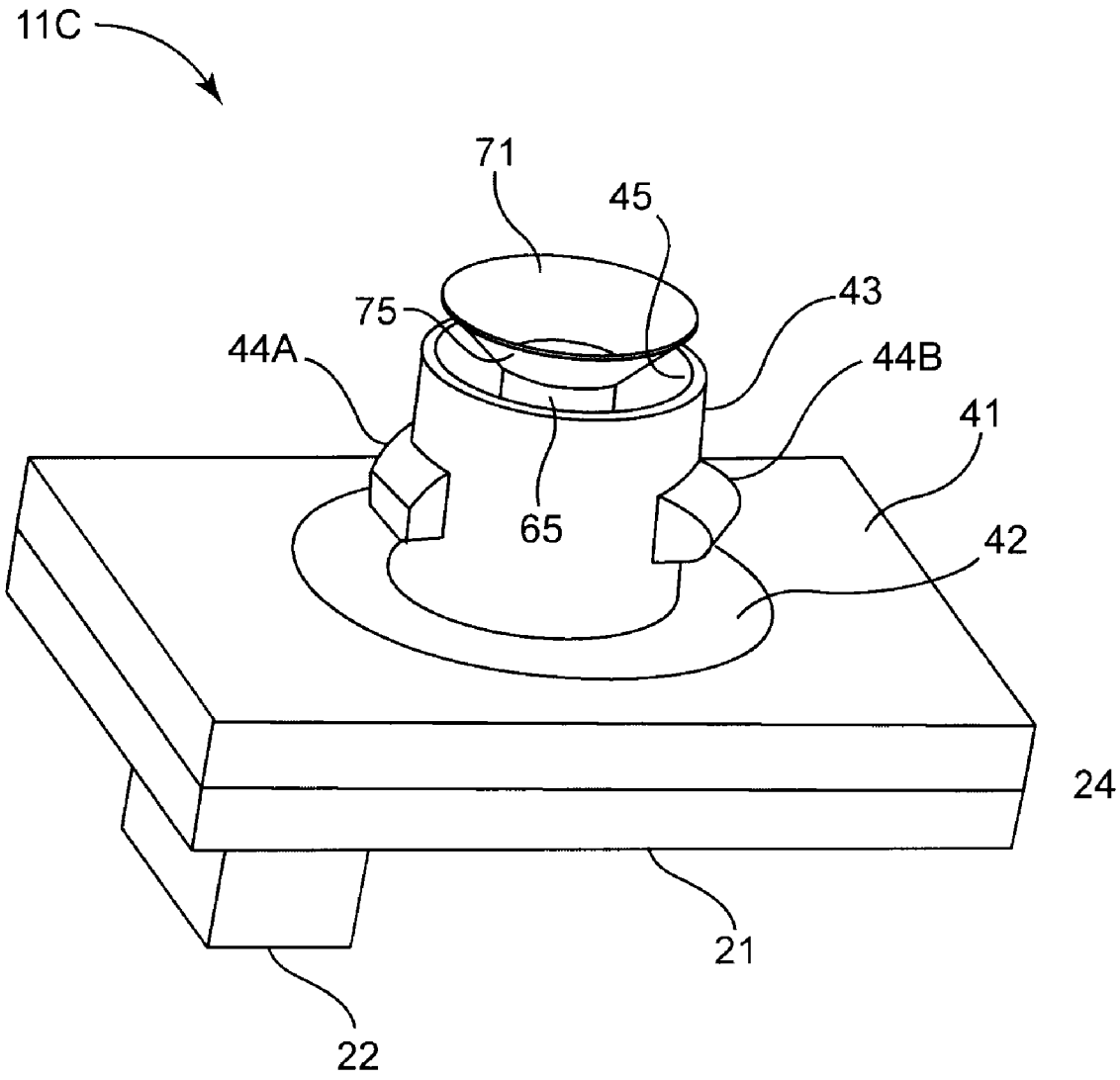
FIG. 5 is an assembled view schematic drawing of an exemplary mechanical layout of an LED module for a rear combination lamp.
Figure 6:
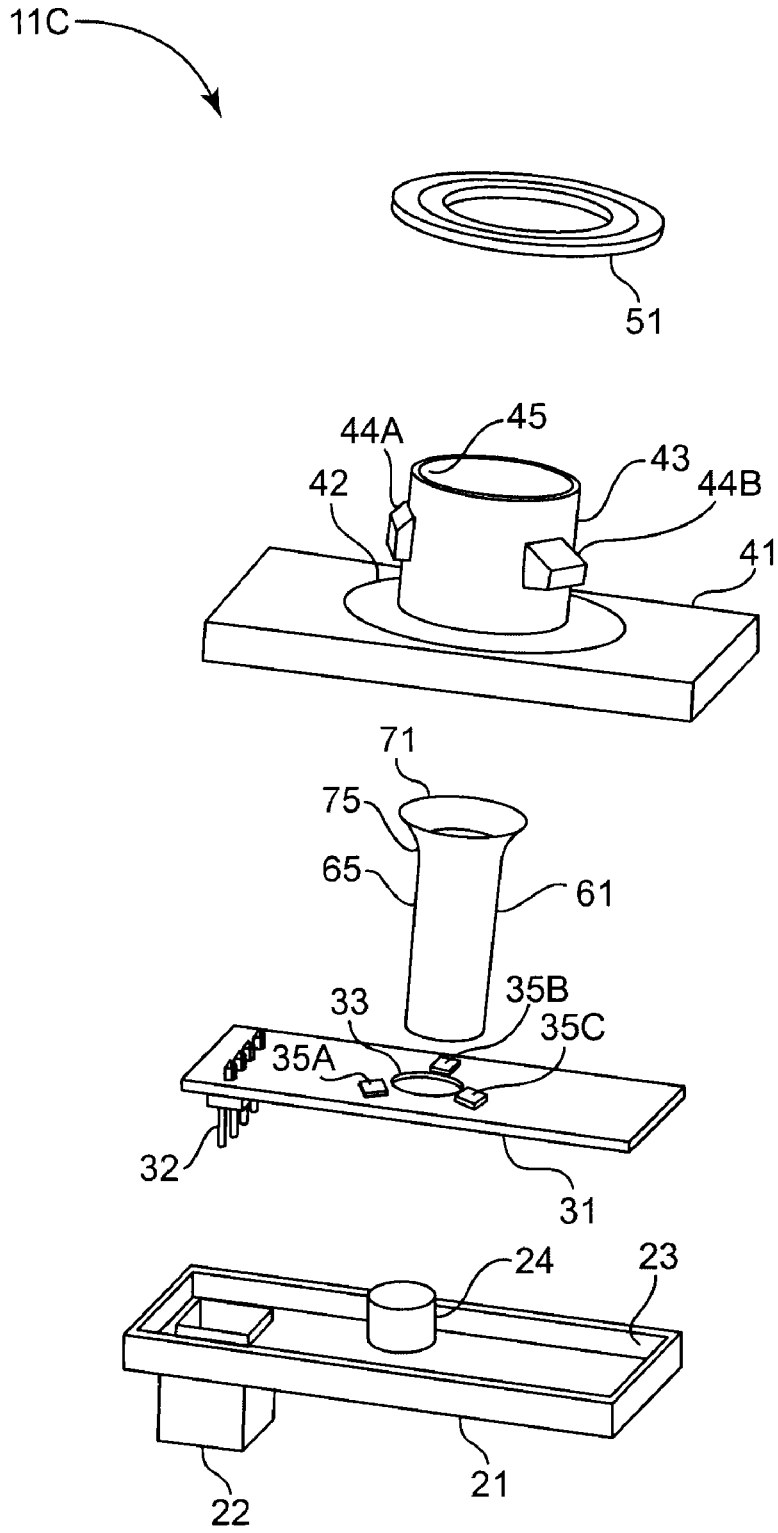
FIG. 6 is an exploded view schematic drawing of the LED module of FIG. 5.

FIGS. 5-7 are assembled, exploded and cross-sectional view schematic drawings, respectively, of an exemplary mechanical layout of an LED module 11C for a rear combination lamp. The LED module 11C is inserted from the rear of the lamp, longitudinally, in a manner similar to that of conventional incandescent lamps. The housing, which includes the parabolic reflector 85, is not shown in FIGS. 5 and 6.

The LED module 11C is constructed in layers, with a proximal layer 41 being closest to the parabolic reflector 85, a printed circuit board 31 that serves as a middle layer, and a distal layer 21 being farthest from the parabolic reflector 85. Each of these layers performs specific functions, and all contribute to the mechanical stability, durability, and electrical and thermal characteristics of the LED module 11C. We begin with a discussion of the printed circuit board 31, and progress outward.

The circuit board 31 includes the electrical circuitry that drives the LEDs 35A, 35B and 35C. The circuitry may be formed in a known manner, using techniques that are commonly applied to printed circuit boards. The LED driver circuit design may be a known design, such as, for example, the design from the reference cited above, U.S. Pat. No. 7,042,165, titled "Driver circuit for LED vehicle lamp", issued to Madhani et al., and assigned to Osram Sylvania Inc. of Danvers, Mass., which is incorporated by reference herein in its entirety. Alternatively, any suitable LED driver circuit may be used.

The LEDs 35A, 35B and 35C are mounted on one side of the printed circuit board 31, so that they all emit in generally the same direction, perpendicular to the plane of the circuit board. In the figures, the LEDs emit light upward, in the proximal direction. In general, it is typical to try and mount the LEDs so that their emissions are truly parallel, but in practice there may be some small variations in the LED pointing angles due to component, manufacturing and assembly tolerances. In general, these small LED pointing errors do not create problems for the lamp.

Although three LEDs are shown in the figures, it will be understood that more or fewer than three LEDs may also be used. For instance, one, two, four, five, six, eight, or more than eight LEDs may be used.

The LEDs 35A, 35B and 35C are arranged around the circumference of a hole 33 in the printed circuit board 31, so that the inner cylinder 61 may pass through the printed circuit board 31 and be secured by distal layer 21. There is no specific requirement on the spacing between the LEDs 35A, 35B and 35C and the hole 33. In some applications, the spacing may be kept as small as practical, to allow for typical manufacturing, alignment and assembly tolerances. There is also no specific requirement on the azimuthal placement of the LEDs 35A, 35B and 35C. In some applications, the LEDs 35A, 35B and 35C may be distributed evenly around the circumference of the hole 33.

The shape, or "footprint", of the printed circuit board 31 may be chosen arbitrarily. In the exemplary design of FIGS. 5-7, the footprint is rectangular. In some applications, a circular printed circuit board may be convenient for mounting into other components that have general cylindrical symmetry. Alternatively, the printed circuit board may be square or rectangular in profile; a rectangular footprint may be conducive to reducing any wasted circuit board material during the manufacturing process. In general, any suitable shape may be used for the printed circuit board 31.

The electrical connections to and from the printed circuit board 31 are made through one or more electrical connectors 32. Connectors such as these are convenient for quickly engaging or disengaging the circuit board. The connector may be a known connector, such as those disclosed in the following two references: U.S. Pat. No. 7,110,656, titled "LED bulb", issued to Coushaine et al., and assigned to Osram Sylvania Inc. of Danvers, Mass., discloses a complementary socket and electrical connector mechanical structure for LED-based lighting modules, and is incorporated by reference herein in its entirety. U.S. Pat. No. 7,075,224, titled "Light emitting diode bulb connector including tension receiver", issued to Coushaine et al., and assigned to Osram Sylvania Inc. of Danvers, Mass., discloses another complementary socket and electrical connector mechanical structure for LED-based lighting modules, and is incorporated by reference herein in its entirety. Alternatively, any suitable connector may be used.

In some applications, the connector 22 may be attached to the printed circuit board 31 itself. In other applications, the connector 22 may be attached to or formed integrally with the distal layer 21, with several electrical pins extending from the printed circuit board 31 to or through the distal layer 21.

The distal layer 21 is located farthest away from the parabolic reflector 85.

The distal layer 21 includes an electrical connector 22 that can easily be attached to and detached from a mated connector on the electrical system of the automobile. The connector 22 may use one or more pins that extend from/to the printed circuit board 31.

The distal layer 21 includes a cylindrical mount 24, for securing the inner cylinder 61. In some applications, the cylindrical mount 24 is keyed, so that the inner cylinder 61 may be mounted only in one or more desired orientations. In other applications, the cylindrical mount 24 is free from any azimuthal features.

In some applications, the inner cylinder 61 is attached to the cylindrical mount 24 using a press fit or a friction fit. In other applications, the inner cylinder 61 and cylindrical mount 24 are attached by screwing them together. In still other applications, adhesives may be used to attach the inner cylinder 61 to the cylindrical mount 24.

The distal layer 21 also serves as a heat sink for dissipating the heat generated by the LEDs 35A, 35B and 35C. The heat sink features may be made from a thermally conductive material, such as aluminum, although any suitable metal may be used. In some applications, the heat sink function may be implicitly built into the cylindrical mount 24, since the LEDs 35A, 35B and 35C are naturally located close to the inner cylinder 61.

The distal layer 21 may also include one or more seals 23 around the connector and/or around the perimeter of the distal layer. In some applications, the distal layer 21 is sealed to the proximal layer 41, with the printed circuit board 31 residing in between and being protected from the elements. The exterior of the distal layer 21 itself may be plastic, metal, or any other suitable material.

The footprint of the distal layer 21 may be rectangular, to match the printed circuit board 31, or may be any other suitable shape and size. In some applications, the distal layer 21 includes a lip around its perimeter, so that the printed circuit board 31 may sit or rest in the "tray"-like shape of the distal layer 21.

The proximal layer 41 is located nearest the parabolic reflector 85. The proximal layer may also have a rectangular footprint, and may match the footprints of the printed circuit board 31 and distal layer 21. In some applications, the proximal layer 41 may be sealed to the distal layer 21 around its perimeter, for protecting the printed circuit board 31 from the elements.

The proximal layer 41 includes an outer cylinder 43 that extends proximally toward the parabolic reflector 85. During assembly of the lamp, the outer cylinder 43 is inserted longitudinally into a hole in the parabolic reflector 85. The outer cylinder 43 may include one or more locating features 44A and 44B, such as quarter-turn features, which are widely used in automotive lamps and can fix the module to the parabolic reflector.

The proximal layer 41 may also include a locating ledge 42, which may be a circular ring surrounding the outer cylinder 43 that is used as a reference surface during assembly. For instance, a seal 51 may be placed over the outer cylinder 43, then the LED module 11C may be inserted longitudinally into the back of the parabolic reflector 85 until firm contact is made between the locating ledge 42 and the seal 51, and between the seal 51 and a corresponding reference surface on the parabolic reflector 85 or on the housing that includes the parabolic reflector 85.

In some applications, the outer cylinder 43 is made separately from the proximal layer 41 and attached afterwards. In other applications, the outer cylinder 43 is made integrally with the proximal layer 41.

When the layers 21, 31 and 41 are assembled, the LEDs 35A, 35B and 35C radiate longitudinally in the volume between the outer surface 65 of the inner cylinder 61 and the inner surface 45 of the outer cylinder 43. Both of these surfaces may be ground and/or polished to remove surface roughness and thereby reduce the amount of scattered light. Both may also be coated with a highly reflective coating, such as chrome, although any suitable high reflectance coating may be used. Light leaves the LEDs 35A, 35B and 35C, undergoes multiple bounces in the volume between the reflective surfaces, and emerges from the cylinders inside the housing, at the focus of the parabolic reflector. Either or both cylinder may contain threads or other fastening and/or locating devices on its non-optical surface.

The inner cylinder 61 includes an outwardly-flared reflector 71 at its proximal end (the end opposite the layered structure). The reflector 71 has a reflective surface 75 that directs the LED light, emergent from the cylinders in a longitudinal direction, radially outward from the cylinders, so that the reflection from the outwardly-flared reflector is mainly transverse. This transverse reflection strikes the parabolic reflector, where it is collimated and directed longitudinally. The collimated longitudinal light passes through a transparent clear cover, and exits the lamp.

The shape of the reflective surface 75 of the outwardly-flared reflector 71 may be conical, trumpet-shaped, inverted-umbrella shaped, or may have any suitable curvature. In some applications, the outwardly-flared reflector 71 may be azimuthally symmetric. In other applications, the outwardly-flared reflector 71 may include segments, with each segment having its own shape and orientation. For instance, the outwardly-flared reflector 71 may include various flat segments, similar to the effect one achieves from placing flat shingles on a curved roof.

In some applications, the radial extent of the outwardly-flared reflector 71 is larger than both inner and outer cylinders, so that all the light leaving the cylinders strikes the reflector 71 and is directed laterally to the parabolic reflector.

In these applications, the inner cylinder 61 is attached last, once the layers 21, 31 and 41 have been assembled, and, optionally, sealed, because such a large reflector 71 would not fit inside the outer cylinder 43. In other applications, the radial extent of the outwardly-flared reflector 71 is larger than the inner cylinder but smaller than the outer cylinder, so that the inner cylinder may be attached to the distal layer before the proximal layer is attached.

Note that the inner and outer cylinders are referred to herein as "cylinders", but in practice, they may deviate from true cylinders. For instance, one or both cylinders may be conic, with the cross-sectional diameter changing from proximal to distal ends of the "cylinder". Such a cone could be used to increase or reduce the size of the outwardly-flared reflector 71, and could desirably change the emission pattern that strikes the parabolic reflector. In other applications, the inner and outer cylinders may be elliptical in cross-section, or may contain one or more straight segments. In general, any suitable shape may be used for the opposing reflective surface that form the so-called "light guiding region" that ports light from the LEDs to the focus of the parabolic reflector.

In some applications, the inner and outer cylinders are coaxial, meaning that they share a common axis 87. In other applications, the inner and outer cylinders are skewed with respect to each other.

The description of the invention and its applications as set forth herein is illustrative and is not intended to limit the scope of the invention. Variations and modifications of the embodiments disclosed herein are possible, and practical alternatives to and equivalents of the various elements of the embodiments would be understood to those of ordinary skill in the art upon study of this patent document. These and other variations and modifications of the embodiments disclosed herein may be made without departing from the scope and spirit of the invention.

We claim:

1. An automotive rear combination lamp (10), comprising:

an inner cylinder (61) having a proximal end and a distal end opposite the proximal end, the inner cylinder (61) comprising a convex cylindrical reflective surface (65);

an outer cylinder (43) surrounding the inner cylinder (61), the outer cylinder (43) comprising a concave cylindrical reflective surface (45) coaxial with and facing the convex cylindrical reflective surface (65), the convex and concave cylindrical reflective surfaces (65, 45) transversely defining a light propagation region;

a printed circuit board (31) disposed at the proximal end of the inner cylinder (61);

a plurality of light emitting diodes (35) disposed on the printed circuit board (31), the diodes (35) being capable of being electrically powered by the printed circuit board (31), the diodes (35) being capable of generating light that propagates longitudinally away from the printed circuit board (31) in the light propagation region; and an outwardly-flared reflector (75) disposed at the distal end of the inner cylinder (61) and adjacent to the light propagation region, for transversely reflecting light that propagates longitudinally in the light propagation region, the flared reflector having an increasing cross-sectional diameter from proximal to distal ends.

2. The automotive rear combination lamp (10) of claim 1, further comprising:

a concave reflector (85) having a focus and having an aperture at its vertex;

wherein the inner and outer cylinders (61, 43) are insertable into the interior of the concave reflector (85) through the aperture in the concave reflector (85);

wherein when the inner and outer cylinders (61, 43) are fully inserted into the concave reflector (85), the outwardly-flared reflector (75) is disposed at the focus of the concave reflector (85), so that light from the light propagation region reflected from the outwardly-flared reflector (75) is collimated by the concave reflector (85).

3. The automotive rear combination lamp (10) of claim 1, wherein the inner cylinder (61) extends through a hole (33) in the printed circuit board (31).

4. The automotive rear combination lamp (10) of claim 1, wherein the outwardly-flared reflector (75) has a radial diameter greater than that of both the convex cylindrical reflective surface (65) and the concave cylindrical reflective surface (45).

5. The automotive rear combination lamp (10) of claim 4, wherein the outwardly-flared reflector (75) has a radial diameter greater than that of both the convex cylindrical reflective surface (65) and the concave cylindrical reflective surface (45) at their distal ends.

6. An automotive rear combination lamp (10), comprising:

a concave reflector (85, 13) having a focus and having an aperture at its vertex, for receiving transversely propagating diverging light and reflecting longitudinally propagating collimated light;

an outwardly-flared reflector (75) disposed at the focus of the concave reflector (85), for receiving longitudinally propagating guided light and reflecting transversely propagating diverging light to the concave reflector (85); and a light guiding region for receiving longitudinally propagating diverging light from at least one light emitting diode (35) and producing longitudinally propagating guided light;

wherein the light guiding region is formed between a convex reflecting surface (65) and a concave reflecting surface (45), the convex and concave reflecting surfaces (65, 45) having cross-sections that are nested, continuous and concentric;

wherein the light guiding region extends through the aperture at the vertex of the concave reflector (85); and wherein the at least one light emitting diode (35) is disposed outside the concave reflector (85).

7. The automotive rear combination lamp (10) of claim 6, wherein the cross-sections of the convex and concave reflecting surfaces (65, 45) are elliptical.

8. The automotive rear combination lamp (10) of claim 6, wherein the cross-sections of the convex and concave reflecting surfaces (65, 45) are circular.

9. The automotive rear combination lamp (10) of claim 6, wherein the convex and concave reflecting surfaces (65, 45) are disposed on adjacent faces of two nested cylinders (61, 43).

10. The automotive rear combination lamp (10) of claim 6, wherein the convex and concave reflecting surfaces (65, 45) are disposed on adjacent faces of two nested cones.

11. The automotive rear combination lamp (10) of claim 6, wherein the convex and concave reflecting surfaces (65, 45) are disposed on an outer face of an inner member (61) and an inner face of an outer member (43), respectively;

wherein the inner member (43) has a proximal end disposed outside the concave reflector (85) and a distal end inside the concave reflector (85);

wherein the outwardly-flared reflector (75) is longitudinally adjacent to the distal end of the inner member (61).

12. The automotive rear combination lamp (10) of claim 11, wherein the outwardly-flared reflector (75) has a radial diameter greater than that of both the inner member (61) and outer member (43) at their distal ends.

13. The automotive rear combination lamp (10) of claim 6, further comprising:

a transversely-oriented printed circuit board (31) for mounting and electrically powering the at least one light emitting diode (35);

wherein the printed circuit board (31) is disposed outside the concave reflector (85).

14. The automotive rear combination lamp (10) of claim 6, wherein the concave reflector (85) is parabolic in shape.

15. The automotive rear combination lamp (10) of claim 6, wherein the concave reflector (13) includes a plurality of facets (19) for angularly diverting the reflected longitudinally propagating collimated light; and wherein the total angular diversions of all the facets (19) collectively forms a predetermined, two-dimensional angular distribution about the reflected longitudinally propagating collimated light exiting direction.

16. An automotive rear combination lamp (10), comprising:

a printed circuit board (31);

an inner cylinder (61) extending away from the printed circuit board (31) and comprising a convex cylindrical reflective surface (65);

an outer cylinder (43) surrounding the inner cylinder (61), the outer cylinder (43) comprising a concave cylindrical reflective surface (45) coaxial with and facing the convex cylindrical reflective surface (65), the convex and concave cylindrical reflective surfaces (65, 45) transversely defining a light propagation region;

a plurality of light emitting diodes (35) disposed on the printed circuit board (31), the diodes (35) being capable of being electrically powered by the printed circuit board (31), the diodes (35) being capable of generating light that propagates longitudinally away from the printed circuit board (31) in the light propagation region; and a trumpet-shaped reflector (75) disposed at a longitudinal end of the inner cylinder (61), opposite the printed circuit board (31) and adjacent to the light propagation region, for transversely reflecting light that propagates longitudinally in the light propagation region;

a concave reflector (85) for collimating and longitudinally reflecting light that is transversely reflected by the trumpet-shaped reflector (75), the concave reflector (85) having a focus and having an aperture at its vertex; and a transparent cover (15) for transmitting collimated light from the concave reflector (85);

wherein the inner and outer cylinders (61, 43) extend through the aperture at the vertex of the concave reflector (85);

wherein the trumpet-shaped reflector (75) is disposed at the focus of the concave reflector (85); and wherein the printed circuit board (31) is disposed outside the concave reflector (85).

17. The automotive rear combination lamp (10) of claim 16, wherein the printed circuit board (31) is sandwiched between a proximal and a distal layer (41, 21) in a layered structure, includes an electrical connector (32) extending proximally away from the printed circuit board (31), and includes a hole (33) through which the inner cylinder (61) passes;

wherein the proximal layer (41) in the layered structure attaches to the outer cylinder (43), the proximal layer (41) being disposed between the printed circuit board (31) and the concave reflector (85);

wherein the distal layer (21) in the layered structure includes a seal (23) around the electrical connector (32), includes a seal (23) with the proximal layer (41), attaches to the inner cylinder (61), and includes a heat sink for dissipating heat generated by the light emitting diodes (35) on the printed circuit board (31).

18. The automotive rear combination lamp (10) of claim 17, wherein the printed circuit board (31), the proximal layer (41) and the distal layer (21) are all generally rectangular in shape.

19. The automotive rear combination lamp (10) of claim 17, wherein the plurality of light emitting diodes (35) are arranged around the circumference of the hole (33) in the printed circuit board (31).

* * * * *